US007878195B2

(12) United States Patent
Alvey et al.

(10) Patent No.: US 7,878,195 B2
(45) Date of Patent: Feb. 1, 2011

(54) HEAT MANAGEMENT SYSTEM FOR INDUSTRIAL SAFETY EQUIPMENT

(75) Inventors: Jeffrey A. Alvey, Union Bridge, MD (US); Keith E. Fecteau, Wilbraham, MA (US); Julie Tremblay, Worcester, MA (US)

(73) Assignee: 3M Innovative Properties Company, St. Paul, MN (US)

( * ) Notice: Subject to any disclaimer, the term of this patent is extended or adjusted under 35 U.S.C. 154(b) by 1170 days.

(21) Appl. No.: 10/442,567

(22) Filed: May 21, 2003

(65) Prior Publication Data

US 2004/0144382 A1 Jul. 29, 2004

(51) Int. Cl.
*A62B 17/04* (2006.01)

(52) U.S. Cl. ..... 128/201.23; 128/201.22; 128/201.24

(58) Field of Classification Search ..... 128/201.23, 128/201.22, 201.24
See application file for complete search history.

(56) References Cited

U.S. PATENT DOCUMENTS

| | | | | | |
|---|---|---|---|---|---|
| 4,150,443 | A * | 4/1979 | McNeilly | 2/436 |
| 4,443,893 | A * | 4/1984 | Yamamoto | 2/436 |
| 4,730,612 | A * | 3/1988 | Dampney | 128/201.24 |
| 4,852,562 | A * | 8/1989 | Howie | 128/201.25 |
| 4,996,981 | A * | 3/1991 | Elenewski et al. | 128/201.15 |
| 5,009,225 | A * | 4/1991 | Vrabel | 128/201.24 |
| 5,054,480 | A * | 10/1991 | Bare et al. | 128/201.25 |
| 5,104,430 | A * | 4/1992 | Her-Mou | 55/385.1 |
| 5,577,495 | A * | 11/1996 | Murphy | 128/201.24 |
| 6,382,208 | B2 * | 5/2002 | Reedy et al. | 128/204.17 |
| 6,752,146 | B1 * | 6/2004 | Altshuler et al. | 128/201.25 |

* cited by examiner

*Primary Examiner*—Tatyana Zalukaeva
*Assistant Examiner*—Ginger T Chapman
(74) *Attorney, Agent, or Firm*—Anna A. Wetzels

(57) ABSTRACT

A heat management system for industrial safety equipment is described, including an industrial safety article (e.g., a full face respirator), a power source and a fan unit, wherein the fan unit is mounted on the industrial safety article such that the fan directs air within a confined or other interior space of the industrial safety article, and wherein the fan unit is powered by the power source.

8 Claims, 3 Drawing Sheets

HEAT MANAGEMENT SYSTEM FOR INDUSTRIAL SAFETY EQUIPMENT

BACKGROUND

The industrial environment oftentimes requires prolonged wearing of various types of industrial safety equipment, including half mask respirators, full face respirators, various types of eyewear and various types of ear protection.

For example, in work environments where the ambient atmosphere contains particulates and/or chemicals that may harm the human respiratory system either for short or for long term exposure, an industrial worker must wear a particulate and/or chemical respirator during most, if not all, of that worker's schedule.

The prolonged use of such respirators may promote stress and/or overheating of that worker, may cause visors to fog or may cause unbearable humidity within the respirator or mask. Elevated levels of stress may lead to elevated heart rates and may promote sweating of the worker, which may promote fogging of the visors. These conditions are particularly complicated in hot or humid environments.

What is needed in the art is an alternate solution to the above noted and other inconveniences and problems associated with prolonged use of such industrial safety equipment.

SUMMARY

The above discussed and other drawbacks and disadvantages of the prior art are overcome and alleviated by the heat management system for industrial safety equipment as presently described. In one exemplary embodiment, the heat management system comprises an industrial safety article, a power source and a fan unit, wherein the fan unit is mounted on the industrial safety article such that the fan directs air within a confined or other interior space of the industrial safety article, and wherein the fan unit is powered by the power source.

The present heat management system will be described in greater detail below with reference to exemplary embodiments and with particular reference to the following FIGURES.

BRIEF DESCRIPTION OF THE DRAWINGS

Referring now to the drawings, wherein like elements are numbered alike in the FIGURES.

DETAILED DESCRIPTION OF EXEMPLARY EMBODIMENTS

Reference will now be made in detail to exemplary embodiments of heat management systems, examples of which are illustrated in the accompanying FIGURES.

Figure 1:
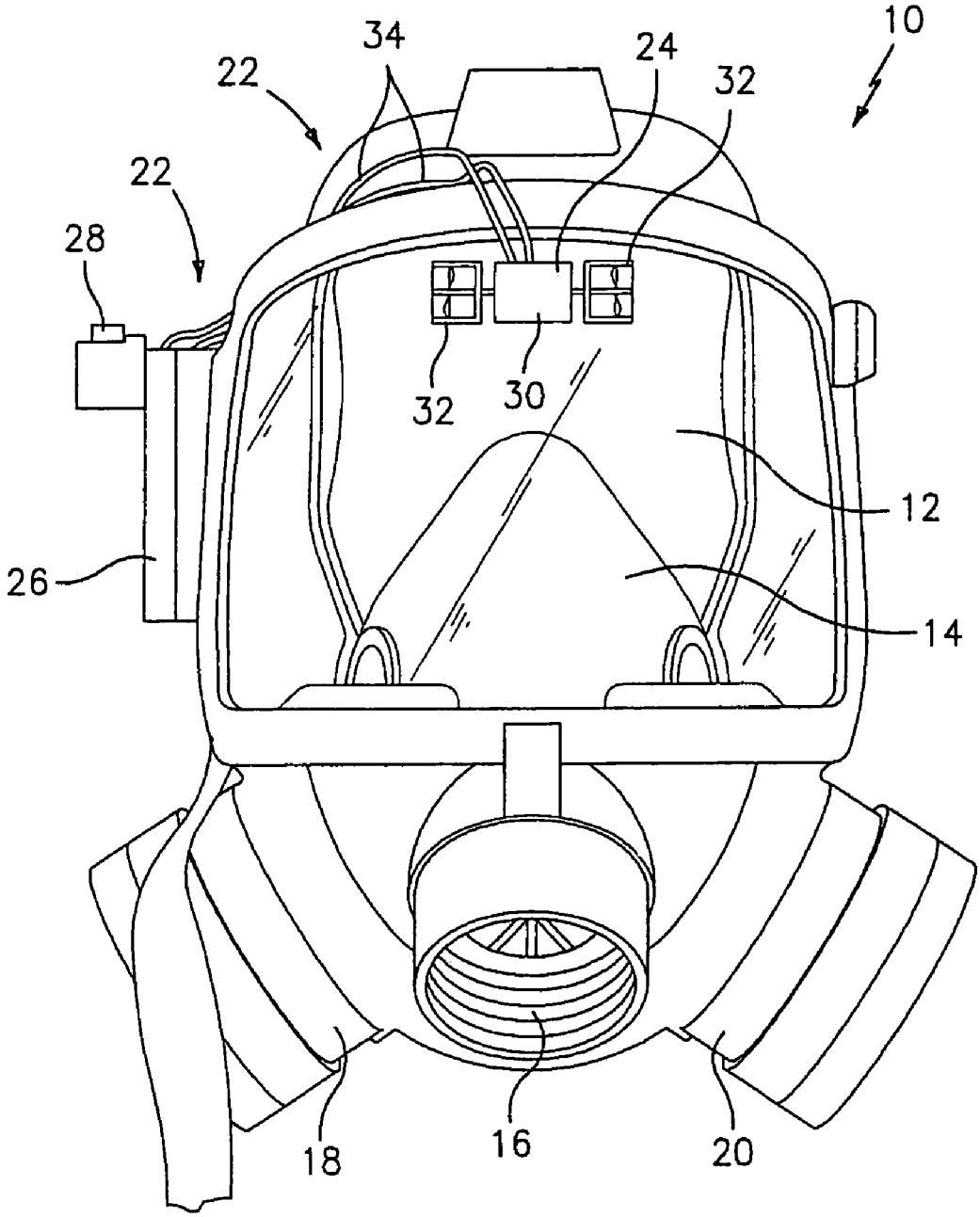
FIG. 1 illustrates a front view of an exemplary full face respirator incorporating an exemplary heat management system.

Referring now to FIG. 1, an exemplary full face respirator is illustrated generally at 10. The illustrated full face respirator 10 generally includes a visor 12, a mask portion 14, an exhalation port 16 and filters 18, 20.

Referring still to FIG. 1, an exemplary heat management system is illustrated generally at 22. The exemplary heat management system 22 comprises at least one fan unit 24, a power source 26 and an activation switch 28. The fan unit 24 may include a motor unit 30 operatively connected to one or more fans 32. The power source pack is illustrated as connected to the fan unit 24 via a pair of electrical cables 34.

As illustrated, the exemplary activation switch 28 may be positioned on one or more of the electrical cables 34 to provide an open or closed circuit according to the position of the activation switch 28. In another embodiment, the exemplary activation switch 28 may also permit varying speeds of operation for the fan unit 24, for example by varying resistance in a closed circuit with a potentiometer device (not illustrated).

Referring still to FIG. 1, the exemplary fan unit 24 is illustrated as being positioned within a confined space of or on an interior surface of the exemplary full face respirator visor 12. As used herein, the term "confined space" means any bounded region between a wearer and the respirator (or other industrial safety article). Similarly, as used herein, an "interior space" means any space between (along a linear path or otherwise) a portion of the respirator (or other industrial safety article) and a wearer of the respirator (or other industrial safety article).

Thus, when the full face respirator is donned, the fan unit 24 is positioned within the confined or other interior space of the full face respirator such that the heat within the confined or other interior space may be controlled or managed. While the fan unit 24 is illustrated in a position which would be adjacent a wearer's brow, one skilled in the art should recognize that the fan unit 24 may be positioned anywhere within the confined or other interior space of the respirator.

Accordingly, one skilled in the art would recognize an extremely versatile design, which may be adaptable to promote movement of air in any region of the respirator's confined or other interior area, or indeed, to promote movement of air in any number of industrial safety products having confined or other interior spaces. Additionally, while FIG. 1 shows a single fan unit 24, alternate embodiments are contemplated by the present disclosure, wherein multiple fan units 24 are controlled by one or more power sources 26 and or activation switches 28. Additionally, embodiments lacking an activation switch are contemplated, for example, wherein a circuit between the power source and the fan unit 24 is closed simply be inserting the power source, e.g. an alkaline battery, into the circuit.

Referring still to FIG. 1, the power source 26 is illustrated in a position external to the confined or other interior space defined by the visor 12 of the full face respirator 10. While such an external position is certainly not required by the present heat management system, such a position may be advantageous for various reasons, e.g. where relatively large alkaline batteries are desired to provide extremely long operation times. In such cases, the external power source may be mounted on external surfaces of the mask, or indeed, on any other convenient external location, e.g., including a position on a belt or in a separate container, among others.

In an alternate exemplary embodiment, one or more of the power source 26 and activation switch 28 (if present) may additionally be positioned either within the confined or other interior space of the respirator 10 or built into the material of the respirator 10.

The power source 26 may be any device that furnishes sufficient power to activate the fan unit 24. In one exemplary embodiment, the power source 26 includes one or more of an alkaline battery, a solar battery and a photovoltaic cell, among others.

Referring still to FIG. 1, in such cases where one or more of the power source 26 and activation switch 28 are positioned externally of the entire respirator 10, it may be desirable to ensure that the entry points of cables 34 are completely sealed, for example by epoxy or other adhesive, or by other methods as may be known in the art, to avoid providing a path of contamination for the air within the confined or other interior space of the respirator 10.

Figure 2:
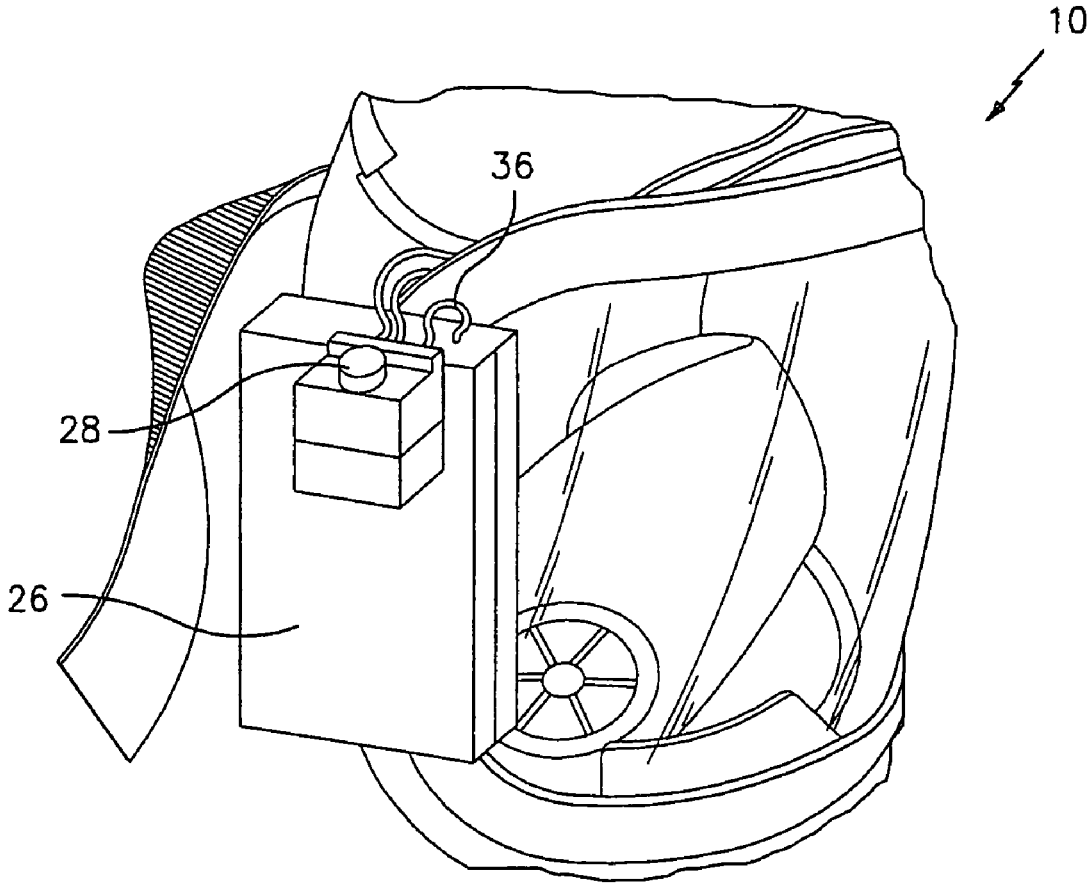
FIG. 2 illustrates an enlarged perspective view of an exemplary power source and activation switch.

Referring now to FIG. 2, an enlarged portion of an exemplary full face respirator 10 mounting the power source 26 and activation switch 28 is shown. The exemplary power source 26 is shown connected to the activation switch 28 via cable 36. The activation switch 28 and the power source are also each connected to the fan unit 24 via cables 34 (see FIG. 1). Thus, closing of the activation switch 28 provides power to the fan unit 24, which causes movement of fan members 32.

Figure 3:
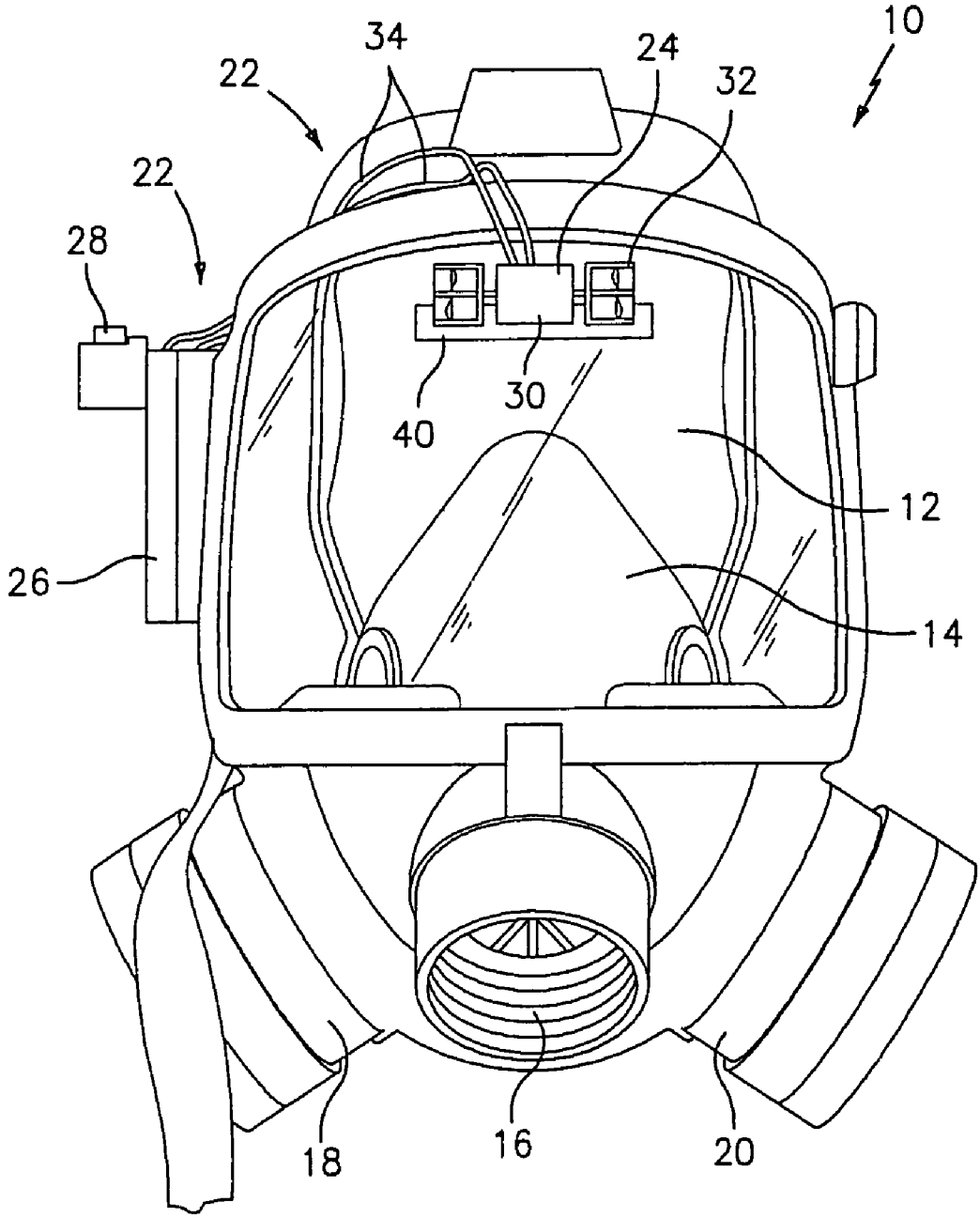
FIG. 3 illustrates a front view of an exemplary full face respirator incorporating an exemplary heat management system and a surface configured to redirect air flow.

Referring now to FIG. 3, another exemplary embodiment is illustrated, wherein a surface 40 may be placed near the fan unit 24 to at least partially direct air in alternate directions, as may be desired. For example, in one exemplary embodiment, a redirecting surface 40 is positioned underneath the fan unit 24 such that air moving from the fan unit 24 is directed away from the eyes and across the brow of a wearer. Such surface 40 may be a separate material adhered in an advantageous position, or may be an existing surface either naturally found or otherwise formed in the industrial safety equipment. Such surface 40 may also be any material, solid or porous. In one exemplary embodiment, such surface 40 is a sponge adhered to the inside of the lens 12 of a full face mask 10.

Additionally, placement of the fan unit 24 may be strategically controlled within the industrial safety equipment to provide the desired direction(s) of air flow and cooling.

While exemplary embodiments have been shown and described with reference to a full face respirator, it should be understood that the present heat management system may be incorporated into any piece of industrial safety equipment where airflow may be beneficial or where the cooling effect of a fan unit may be desired to combat the discomfort of prolonged use of the equipment. For example and without limitation, the heat management system may be used with any industrial safety equipment having confined or other interior spaces, including full face respirators, half mask respirators, goggle, or other eyewear or visor equipment, such as face shields, or hearing equipment, such as earmuffs, among others, for mounting a fan unit or for accommodating air flow from a fan unit configured to direct air flow into the confined or interior spaces.

The present heat management system thus advantageously provides a mechanism for alleviating the problems presented by prolonged use of industrial safety equipment. The resultant promoting of airflow within the equipment not only cools the worker, but also reduces stale air within the equipment, reduces sweating by the worker, reduces fogging or wetting of the equipment (e.g., improves vision for visual safety devices and reduces chafing), and reduces the stress levels of the worker (e.g., encourages the worker to maintain a lower heart rate).

While the invention has been described with reference to an exemplary embodiment, it will be understood by those skilled in the art that various changes may be made and equivalents may be substituted for elements thereof without departing from the spirit or scope of the invention. In addition, many modifications may be made to adapt a particular situation or material to the teachings of the invention without departing from the essential scope thereof. Therefore, it is intended that the invention not be limited to the particular embodiment disclosed as a best mode contemplated for carrying out the invention, but that the invention will include all embodiments falling within the scope of the appended claims.

What is claimed is:

1. An industrial safety article, comprising:

a visor, a mask portion, an exhalation port, at least one filter, a power source, and a fan unit mounted within an interior space at least partially defined by the visor and a face of a wearer, wherein at least one surface comprising porous material is positioned within the interior space to at least partially redirect air moving from the fan unit, and wherein the fan unit is powered by the power source.

2. The industrial safety article in accordance with claim 1, further comprising an activation switch for activating the fan unit.

3. The industrial safety article in accordance with claim 2, wherein the activation switch permits for varying speeds of operation for the fan unit.

4. The industrial safety article in accordance with claim 2, wherein the activation switch is mounted externally of the interior space of the industrial safety article.

5. The industrial safety article in accordance with claim 1, wherein the power source is mounted externally of the interior space.

6. The industrial safety article in accordance with claim 1, wherein the fan unit comprises a motor and at least one fan member operatively connected to the motor.

7. The industrial safety article in accordance with claim 1, wherein the at least one surface is positioned adjacent the fan unit such that air moving from the fan unit is at least partially redirected away from a wearer's eyes.

8. The industrial safety article in accordance with claim 1, comprising two filters.

* * * * *